US010989199B2

(12) United States Patent
Østergaard et al.

(10) Patent No.: US 10,989,199 B2
(45) Date of Patent: Apr. 27, 2021

(54) SUBMERSIBLE DOWNHOLE PUMP

(71) Applicant: GRUNDFOS HOLDING A/S, Bjerringbro (DK)

(72) Inventors: Lars Østergaard, Randers NV (DK); Brian Nonbo Jensen, Viborg (DK)

(73) Assignee: GRUNDFOS HOLDING A/S, Bjerringbro (DK)

( * ) Notice: Subject to any disclaimer, the term of this patent is extended or adjusted under 35 U.S.C. 154(b) by 250 days.

(21) Appl. No.: 16/017,116

(22) Filed: Jun. 25, 2018

(65) Prior Publication Data

US 2018/0372106 A1 Dec. 27, 2018

(30) Foreign Application Priority Data

Jun. 26, 2017 (EP) ..... 17177876

(51) Int. Cl.

| | |
|---|---|
| ***F04D 13/10*** | (2006.01) |
| ***F04D 29/40*** | (2006.01) |
| ***F04D 29/60*** | (2006.01) |
| ***E21B 43/12*** | (2006.01) |
| ***E21B 41/00*** | (2006.01) |

(52) U.S. Cl.

CPC ..... *F04D 13/10* (2013.01); *E21B 41/0021* (2013.01); *E21B 43/121* (2013.01); *E21B 43/128* (2013.01); *F04D 29/40* (2013.01); *F04D 29/605* (2013.01); *F04D 29/606* (2013.01); *F05D 2230/68* (2013.01)

(58) Field of Classification Search

CPC ..... E21B 23/01; E21B 43/121; E21B 43/128; F04D 13/10; F04D 29/606; F04D 29/40; F04D 29/605

See application file for complete search history.

(56) References Cited

U.S. PATENT DOCUMENTS

| | | | | |
|---|---|---|---|---|
| 2,897,898 A * | 8/1959 | Wynn | E21B 23/01 166/212 |
| 2,930,327 A * | 3/1960 | Linkous | E21B 23/01 166/206 |
| 3,468,258 A | 9/1969 | Arutunoff | |
| 4,435,132 A * | 3/1984 | Haesloop | B63C 7/006 222/381 |
| 4,546,830 A * | 10/1985 | McLaughlin | B09C 1/002 166/326 |

(Continued)

FOREIGN PATENT DOCUMENTS

| | | |
|---|---|---|
| CN | 202 100 488 U | 1/2012 |
| CN | 203 962 479 U | 11/2014 |

(Continued)

*Primary Examiner* — Dominick L Plakkoottam

(74) *Attorney, Agent, or Firm* — McGlew and Tuttle, P.C.

(57) ABSTRACT

A submersible downhole pump (1) includes an elongate pump unit (3) defining a longitudinal pump axis (L) and a pump unit diameter (D), and at least one cable lug (13) for attaching a cable. The at least one cable lug (13) is connected to the pump unit (3) and pivotable around a pivot axis (P) perpendicular to the longitudinal axis (L) between a defined first position and a defined second position. The at least one cable lug (13) is positioned, in the first position, fully within the pump unit diameter (D). In the second position, the at least one cable lug (13) is positioned at least partially protruding outside the pump unit diameter (D).

20 Claims, 4 Drawing Sheets

(56) References Cited

U.S. PATENT DOCUMENTS

| | | | | |
|---|---|---|---|---|
| 6,276,824 | B1 * | 8/2001 | De Jager | F04D 29/606 366/195 |
| 7,625,024 | B2 * | 12/2009 | Wright | B66C 1/66 294/215 |
| 7,699,100 | B2 * | 4/2010 | Robichaux | E21B 33/068 166/193 |
| 8,016,033 | B2 * | 9/2011 | Iblings | E21B 19/16 166/244.1 |
| 9,254,987 | B2 * | 2/2016 | Alba | B66C 23/185 |
| 9,422,137 | B2 * | 8/2016 | Kearney | B66C 1/66 |
| 9,874,231 | B2 | 1/2018 | Hare | |
| 2010/0078950 | A1 * | 4/2010 | Inda | B66C 1/66 294/215 |
| 2010/0201141 | A1 * | 8/2010 | Wright | B63B 21/54 294/191 |
| 2015/0192130 | A1 | 7/2015 | Yazykov | |
| 2015/0198171 | A1 * | 7/2015 | Yazykov | E21B 33/0407 417/313 |
| 2018/0229984 | A1 * | 8/2018 | Reimer | B66D 5/16 |

FOREIGN PATENT DOCUMENTS

| | | | |
|---|---|---|---|
| EP | 2 101 062 | A2 | 9/2009 |
| RU | 123076 | U1 | 12/2012 |

* cited by examiner

SUBMERSIBLE DOWNHOLE PUMP

CROSS REFERENCE TO RELATED APPLICATIONS

This application claims the benefit of priority under 35 U.S.C. § 119 of European Application 17 177 876.4, filed Jun. 26, 2017, the entire contents of which are incorporated herein by reference.

TECHNICAL FIELD

The present disclosure relates generally to submersible downhole pumps for usage in wells, vertical pipes or tanks. Submersible downhole pumps are sometimes referred to as submersible borehole pumps.

BACKGROUND

Submersible downhole pumps are typically used in wells, vertical pipes or tanks for pumping fluid upward a riser duct connected to the pump. For a submersible downhole pump to fit into a well or a vertical pipe, the lateral dimension is quite limited so that submersible downhole pumps often have an elongate shape. Sometimes, the pump diameter is not much larger than the diameter of the riser duct. Therefore, the riser duct acts as a suspension for the pump. However, in case the connection between the pump and the riser duct gets loose or the riser duct breaks, there is a risk of losing the pump in the well or the vertical pipe.

EP 2 101 062 A1 discloses a motor pump with transportation lugs being pivotable around a longitudinal pump axis. Such known radially protruding lugs are not useful for securing submersible downhole pumps during operation, because a submersible downhole pump must fit into narrow wells or vertical pipes for operation.

SUMMARY

In contrast to known submersible downhole pumps, embodiments of the present disclosure provide a user-friendly safety mechanism to prevent a pump from dropping down in the well or vertical pipe.

In accordance with the present disclosure, a submersible downhole pump is provided comprising an elongate pump unit defining a longitudinal pump axis and a pump unit diameter, and at least one cable lug for attaching a cable, wherein the at least one cable lug is connected to the pump unit and pivotable around a pivot axis perpendicular to the longitudinal axis between a defined first position and a defined second position, wherein the at least one cable lug is positioned, in the first position, fully within the pump unit diameter and, in the second position, at least partially protruding outside the pump unit diameter.

Thus, a safety cable can be attached to the at least one cable lug in a convenient and user-friendly way when the lug is in the second position. Once the safety cable is attached to the lug, the lug can be pivoted into the first position allowing the pump to be lowered down into the well or vertical pipe. The safety cable may then prevent the pump from dropping down in the well or vertical pipe. The upper end of the safety cable may be attached to the riser duct or the safety cable may run in parallel to the riser duct and may be secured independently from the riser duct by the user above ground.

Optionally, the at least one cable lug may comprise a first cable lug at a first lateral side and a second cable lug at a second lateral side, wherein the first lateral side is opposite the second lateral side. Thereby, a safety redundancy may be provided by two safety cables. Alternatively or in addition, the lugs may be used to suspend the pumps by suspension cables. The suspension cables may carry most of or all of the pump weight to relieve the riser duct and its pump connection from carrying the weight of the pump. The opposite lateral configuration of two cable lugs also provides a steering option. A user may tilt/rotate the pump by pulling one suspension cable stronger than the other and/or rotate the pump the pump by pulling the suspension cables in opposite tangential directions. Thereby, the pump may be steered like a string puppet around cants or protrusions within the well or the vertical pipe for lowering the pump into a water reservoir. It should be understood that the pump may be used for pumping water or any other fluid like oil, gasoline, or any form of fluidic tank fillings. For instance, the submersible downhole pump may be used within a tank and/or a vertical pipe within a tank.

Optionally, the at least one cable lug may be fixed in the second position in such a way that a minimum torque is required to pivot the at least one cable lug into and/or out of the second position. This is more convenient for the user to attach a safety cable and/or suspension cable to the lug in the second position.

Optionally, the pump unit may define an upper pump end and the at least one cable lug is positioned, in the second position, fully below a top face of the upper pump end and, in the first position, at least partially above the top face of the upper pump end. This is especially beneficial if the diameter of the riser duct is not much smaller than the pump unit diameter. The lug at the upper lateral edge of the pump unit may, in the first position, then fit into the residual lateral space between the riser duct and the wall of the well or vertical pipe, while allowing an easy mounting of the safety cable to the lug in the second position. Thus, the at least one cable lug may be arranged at an upper lateral edge of the pump unit.

Optionally, the pump unit may define an inner volume for accommodating an anchor portion of the at least one cable lug and at least one opening for a loop body of the at least one cable lug to protrude out of the inner volume, wherein the dimensions of the inner volume and/or the at least one opening are configured to resiliently deform the anchor portion of the at least one cable lug when it is pivoted from the first position into the second position. This allows for a simple and cost-efficient installation of the lug and the pump assembly during the pump production.

Optionally, the at least one cable lug may be formed as an essentially a-shaped hook or strap with legs inside the pump unit and a loop body protruding outside the pump unit. The lug may be elastic, rigid or limp. The a-shaped lug may have legs with ends facing away from each other or with legs having knees facing away from each other and ends facing toward each other.

Optionally, the loop body may be essentially U-shaped or it may form essentially a circular arc over at least 270°. Thereby, the lug is stable, fracture-proof and provides a defined orifice for threading a safety cable into it.

Optionally, the at least one cable lug may comprise a resiliently deformable material like plastic or metal. The at least one cable lug may be formed as a spring. Thereby, no further movable parts are needed to fix the lug into the second position.

The present invention will be described in detail below with reference to the attached figures. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DETAILED DESCRIPTION

Figure 1:
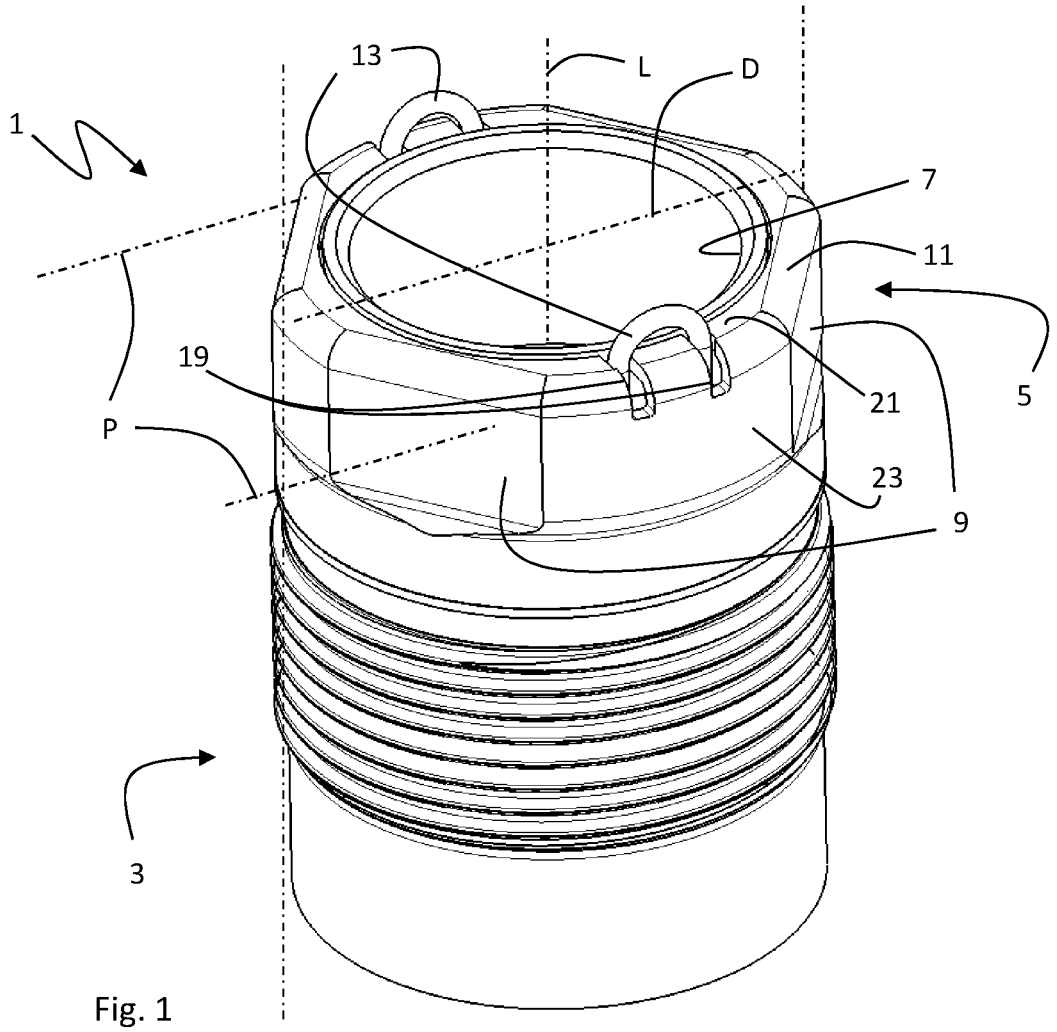
FIG. 1 is a perspective view of an upper portion of an example of a pump according to an embodiment of the present disclosure, wherein the cable lugs are in the first position.

Referring to the drawings, FIG. 1 shows an upper portion of a submersible downhole pump 1 with an elongate pump unit 3. The elongate pump unit 3 defines a longitudinal axis L and a pump unit diameter D. The pump unit diameter D shall be defined here by the diameter of a virtual cylindrical envelope being coaxial to the longitudinal axis L and touching the point(s) of the pump unit 3 radially furthest away from the longitudinal axis L. The pump unit diameter D may thus determine whether the pump unit 3 fits into a well or a vertical pipe.

The upper pump end 5 of the pump unit 3 is here defined by a union nut for connecting a riser duct (not shown) to the pump unit 3. The upper pump end 5 defines an outlet opening 7 through which the riser duct fits. The union nut may be screwed on a thread (not visible) of the pump unit 3 to secure an end flange of the riser duct to the pump unit 3. The union nut has here an octagonal cross-section and defines four peripheral spanner contact surfaces 9 for engaging with a spanner for tightening/loosening the union nut.

The upper pump end 5 in form of a union nut also defines an upper lateral edge 11 which is rounded in the shown example. The submersible downhole pump 1 further comprises two cable lugs 13 for attaching a cable (not shown), wherein the cable lugs 13 are located at the upper lateral edge 11 at opposite lateral sides of the pump unit 3 circumferentially between the spanner contact surfaces 9.

Figure 6:
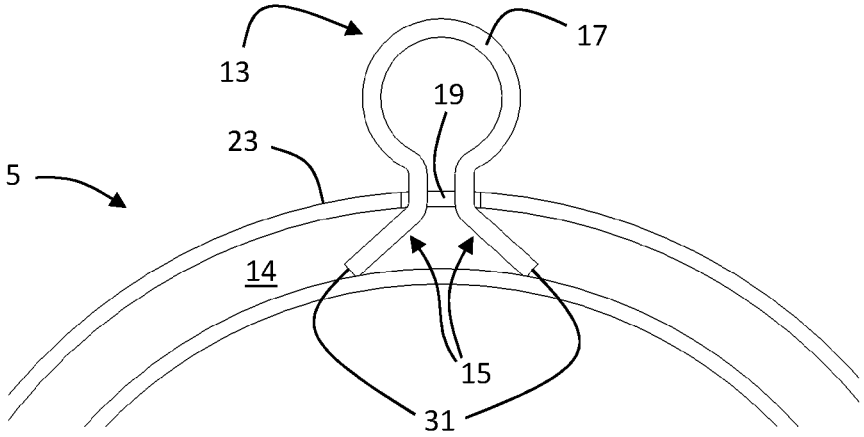
FIG. 6 is a partial cross-sectional view through an upper portion of an example of a pump according to a second embodiment of the present disclosure, wherein the cable lug is in the second position.
Figure 7:
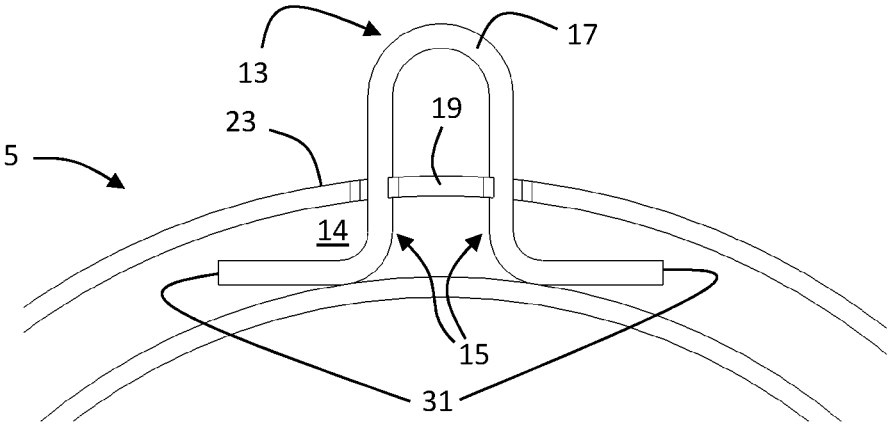
FIG. 7 is a partial cross-sectional view through an upper portion of an example of a pump according to a third embodiment of the present disclosure, wherein the cable lug is in the second position.

The cable lugs 13 are formed as a hook having an a-shape with an anchor portion in form of legs 15 inside the upper pump end 5 of the pump unit 3 and a U-shaped loop body 17 protruding outside the upper pump end 5 of the pump unit 3 (see FIG. 7). The upper pump end 5 defines an inner volume 14 (see FIGS. 5 to 9) for accommodating the anchor portion in form of legs 15 and two openings 19 to the inner volume 14 for each cable lug 13. The openings 19 are formed as two parallel slots running in radial and longitudinal direction from a top face 21 of the upper pump end 5 to a peripheral wall 23 of the upper pump end 5 via the upper lateral edge 11. The openings 19 allow for a pivoting movement of each of the cable lugs 13 around an associated pivot axis P perpendicular to the longitudinal axis L. In FIG. 1, the cable lugs 13 are positioned in the first position, fully within the pump unit diameter D and partially protruding above the top face 21 of the upper pump end 5. In this first position of the cable lugs 13, the pump 1 may be lowered down into a borehole, a well, a tank or a vertical pipe with safety and/or suspension cables (not shown) being attached to the cable lugs 13.

Figure 2:
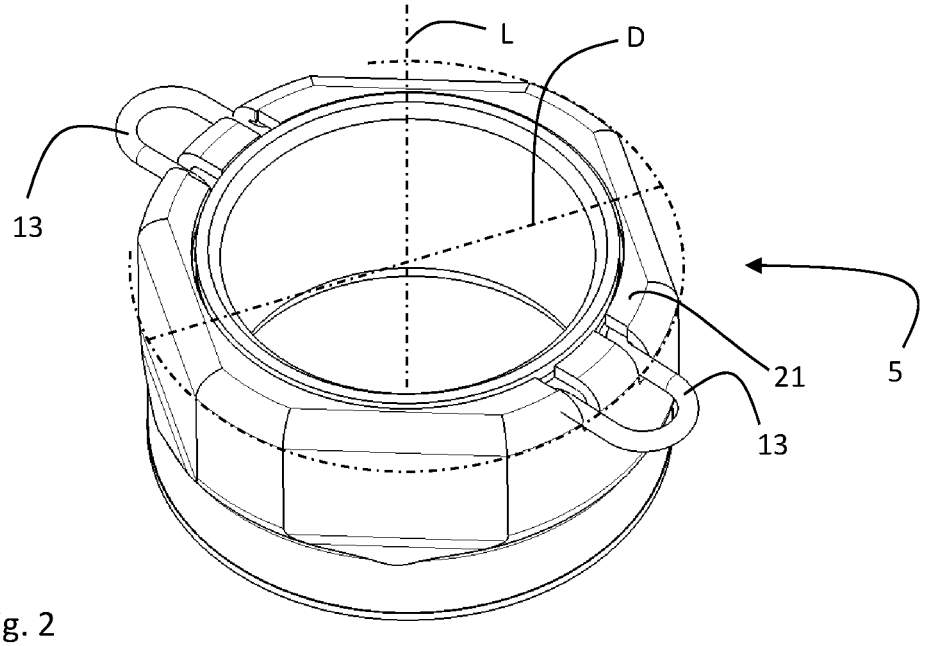
FIG. 2 is a perspective detailed view of an upper portion of an example of a pump according to an embodiment of the present disclosure, wherein the cable lugs are in the second position.
Figure 3:
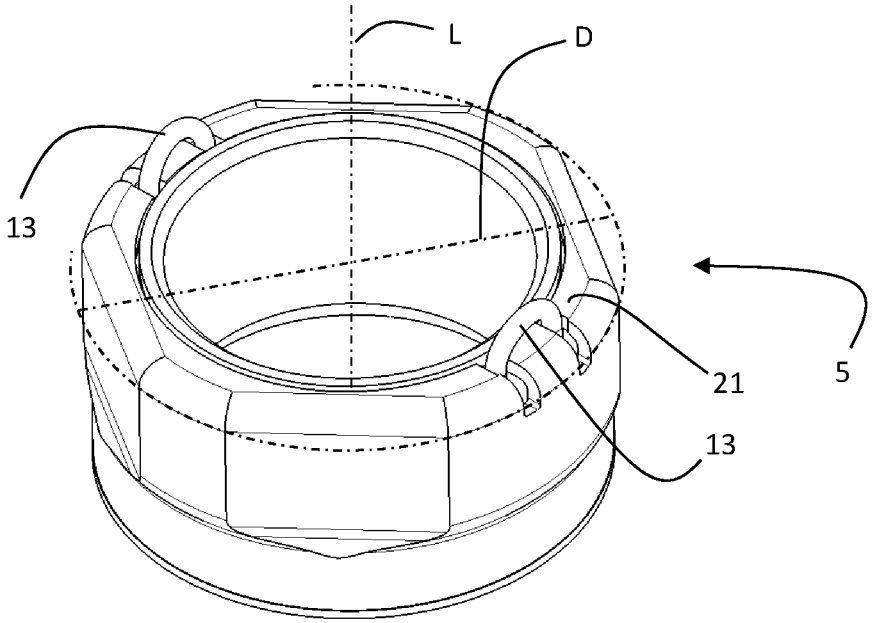
FIG. 3 is a perspective detailed view of an upper portion of an example of a pump according to an embodiment of the present disclosure, wherein the cable lugs are in the first position.

FIG. 2 shows the upper pump end 5 with the cable lugs 13 in the second position partially protruding outside the pump unit diameter D and being fully below the top face 21 of the upper pump end 5. The pivoting movement between the first position and the second position is essentially a rotation by approximately 90° around the respective pivot axis P. The cable lugs 13 pivot independently from each other, but in mutually opposite directions from the first position to the second position and vice versa. In this second position of the cable lugs 13, safety and/or suspension cables (not shown) may be easily attached to the cable lugs 13. FIG. 3 shows the upper pump end 5 with the cable lugs 13 in the second position similar to FIG. 1.

Figure 4:
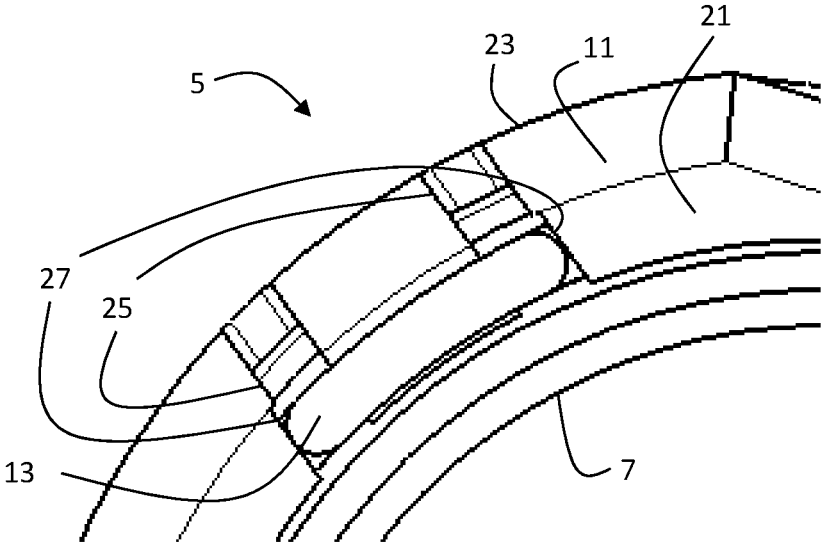
FIG. 4 is a top detailed view of an upper portion of an example of a pump according to an embodiment of the present disclosure, wherein the cable lug is in the first position.

The top of FIG. 4 shows that the openings 19 have a radially outer portion 25 and a radially inner portion 27. The radially outer portion 25 defines a narrower path for the cable lug 13 than the radially inner portion 27. In the first (vertical) position, the cable lug 13 protrudes vertically through the wider radially inner portion 27. For the cable lug 13 to fit into the radially outer portion 25, the legs 15 (see FIG. 7) of the cable lug 13 are flexibly pushed toward each other. By way of this resilient deformation, the cable lug 13 acts as a spring spreading its legs 15 and thereby urging the legs 15 into frictional contact with the side walls of the openings 19. This frictional contact fixes the cable lug 13 in the second (horizontal) position.

Figure 5:
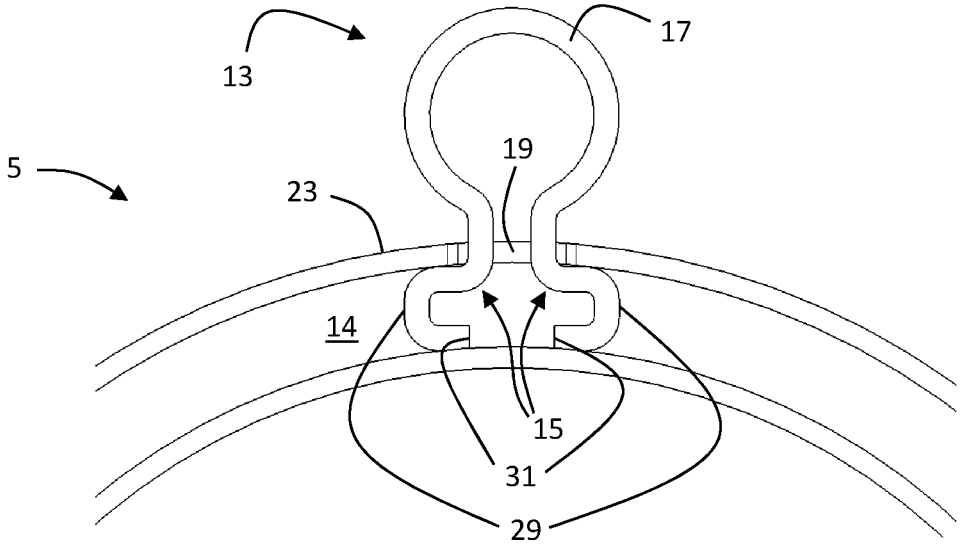
FIG. 5 is a partial cross-sectional view through an upper portion of an example of a pump according to a first embodiment of the present disclosure, wherein the cable lug is in the second position.

FIGS. 5 and 6 show an alternative or additional way to fix the cable lugs 13 in the shown second (horizontal) position. The inner volume 14 defines a radial dimension and an axial dimension around the anchor portion of the cable lug 13. The anchor portion in form of legs 15 is sized to fit into the axial dimension of the inner volume 14 when the cable lug is in the first (vertical) position, and to fit into the radial dimension of the inner volume 14 when the cable lug 13 is in the second (horizontal) position only upon resilient deformation of the legs 15. In this case, the openings 19 may or may not have a narrower radially outer portion 25 in addition. The openings 19 may be one slot for each cable lug 13.

In the embodiment shown in FIG. 5, the a-shaped cable lug 13 has an open O-shaped loop body 17 and legs 15 having knees 29 facing away from each other and ends 31 facing toward each other. The smaller radial dimension of the inner volume 14 urges the knees 29 to flexibly bend. By way of this resilient deformation, the cable lug 13 acts as a spring bending its knees 29 and thereby urging the ends 31 into frictional contact with the walls of the inner volume 14. This frictional contact fixes the cable lug 13 in the second (horizontal) position.

In the embodiment shown in FIG. 6, the a-shaped cable lug 13 has an open O-shaped loop body 17 and spread legs 15 without knees and ends 31 facing away from each other. The smaller radial dimension of the inner volume 14 urges the legs 15 to flexibly spread. By way of this resilient deformation, the cable lug 13 acts as a spring spreading its legs 15 and thereby urging the ends 31 into frictional contact with the walls of the inner volume 14. This frictional contact fixes the cable lug 13 in the second (horizontal) position.

As explained earlier, in the embodiment shown in FIG. 7, the a-shaped cable lug 13 has an open U-shaped loop body 17 and spread legs 15 without knees and ends 31 facing away from each other. The frictional contact for fixing the cable lug 13 in the second (horizontal) position is due to a narrower radially outer portion 25 of the opening 19.

Figure 8:
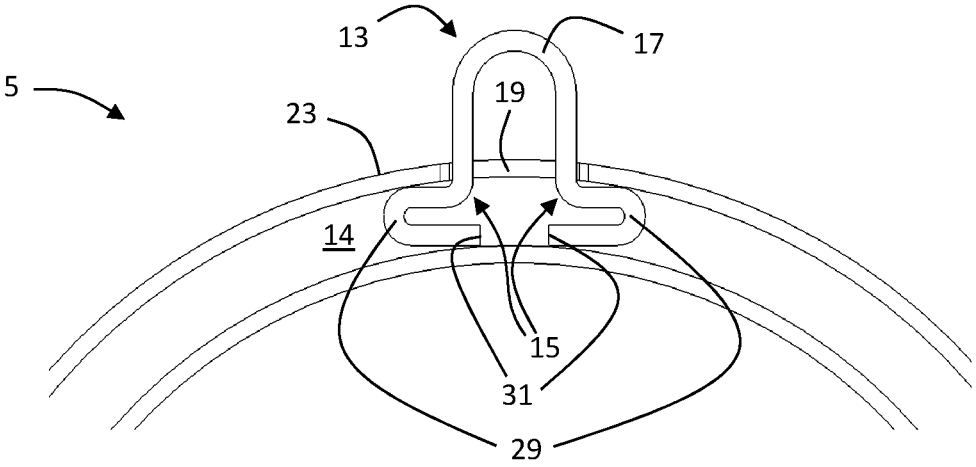
FIG. 8 is a partial cross-sectional view through an upper portion of an example of a pump according to a fourth embodiment of the present disclosure, wherein the cable lug is in the second position.

In the embodiment shown in FIG. 8, the a-shaped cable lug 13 has an open U-shaped loop body 17 and legs 15 having knees 29 facing away from each other and ends 31 facing toward each other. The smaller radial dimension of the inner volume 14 urges the knees 29 to flexibly bend. By way of this resilient deformation, the cable lug 13 acts as a spring bending its knees 29 and thereby urging the ends 31 into frictional contact with the walls of the inner volume 14. This frictional contact fixes the cable lug 13 in the second (horizontal) position.

Figure 9:
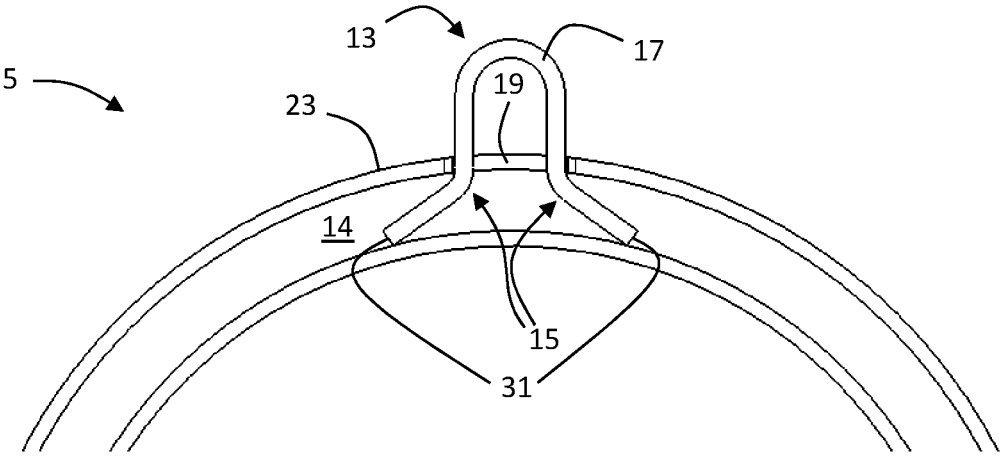
FIG. 9 is a partial cross-sectional view through an upper portion of an example of a pump according to a fifth embodiment of the present disclosure, wherein the cable lug is in the second position.

In the embodiment shown in FIG. 9, the Ω-shaped cable lug 13 has an open U-shaped loop body 17 and spread legs 15 without knees and ends 31 facing away from each other. The smaller radial dimension of the inner volume 14 urges the legs 15 to flexibly spread. By way of this resilient deformation, the cable lug 13 acts as a spring spreading its legs 15 and thereby urging the ends 31 into frictional contact with the walls of the inner volume 14. This frictional contact fixes the cable lug 13 in the second (horizontal) position.

Where, in the foregoing description, integers or elements are mentioned which have known, obvious or foreseeable equivalents, then such equivalents are herein incorporated as if individually set forth. Reference should be made to the claims for determining the true scope of the present disclosure, which should be construed so as to encompass any such equivalents. It will also be appreciated by the reader that integers or features of the disclosure that are described as optional, preferable, advantageous, convenient or the like are optional and do not limit the scope of the independent claims.

The above embodiments are to be understood as illustrative examples of the disclosure. It is to be understood that any feature described in relation to any one embodiment may be used alone, or in combination with other features described, and may also be used in combination with one or more features of any other of the embodiments, or any combination of any other of the embodiments. While at least one exemplary embodiment has been shown and described, it should be understood that other modifications, substitutions and alternatives are apparent to one of ordinary skill in the art and may be changed without departing from the scope of the subject matter described herein, and this application is intended to cover any adaptations or variations of the specific embodiments discussed herein.

In addition, "comprising" does not exclude other elements or steps, and "a" or "one" does not exclude a plural number. Furthermore, characteristics or steps which have been described with reference to one of the above exemplary embodiments may also be used in combination with other characteristics or steps of other exemplary embodiments described above. Method steps may be applied in any order or in parallel or may constitute a part or a more detailed version of another method step. It should be understood that there should be embodied within the scope of the patent warranted hereon all such modifications as reasonably and properly come within the scope of the contribution to the art. Such modifications, substitutions and alternatives can be made without departing from the spirit and scope of the disclosure, which should be determined from the appended claims and their legal equivalents.

While specific embodiments of the invention have been shown and described in detail to illustrate the application of the principles of the invention, it will be understood that the invention may be embodied otherwise without departing from such principles.

What is claimed is:

1. A submersible downhole pump comprising:

an elongate pump unit defining a longitudinal pump axis and a pump unit diameter and an upper pump end; and at least one cable lug for attaching a cable, wherein the at least one cable lug is connected to the pump unit and pivotable, around a pivot axis perpendicular to the longitudinal axis, between a defined first position and a defined second position, wherein, in the first position, the at least one cable lug is positioned fully within the pump unit diameter and, in the second position, the at least one cable lug is positioned at least partially protruding outside the pump unit diameter, and an anchor portion of the at least one cable lug is positioned below a top face of the upper pump end and within the pump unit diameter.

2. The submersible downhole pump according to claim 1, wherein:

the at least one cable lug comprises a first cable lug at a first lateral side and a second cable lug at a second lateral side; and the first lateral side is opposite the second lateral side.

3. The submersible downhole pump according to claim 1, wherein the at least one cable lug is fixed in the second position such that a minimum torque is required to pivot the at least one cable lug into the second position or a minimum torque is required to pivot the at least one cable lug out of the second position or a minimum torque is required to pivot the at least one cable lug into the second position and a minimum torque is required to pivot the at least one cable lug out of the second position.

4. The submersible downhole pump according to claim 1, wherein: the at least one cable lug is positioned, in the second position, fully below the top face of the upper pump end; and the at least one cable lug is positioned, in the first position, at least partially above the top face of the upper pump end.

5. The submersible downhole pump according to claim 1, wherein the at least one cable lug is arranged at an upper lateral edge of the pump unit.

6. The submersible downhole pump according to claim 1, wherein:

the pump unit defines an inner volume for accommodating the anchor portion of the at least one cable lug and at least one opening for a loop body of the at least one cable lug to protrude out of the inner volume; and the dimensions of the inner volume or the dimensions of the at least one opening or both the dimensions of the inner volume and the dimensions of the at least one opening are configured to resiliently deform the anchor portion of the at least one cable lug when the at least one cable lug is pivoted from the first position into the second position.

7. The submersible downhole pump according to claim 1, wherein the at least one cable lug is formed as an essentially a-shaped hook or strap with legs inside the pump unit and a loop body protruding outside the pump unit.

8. The submersible downhole pump according to claim 7, wherein the legs have ends facing away from each other.

9. The submersible downhole pump according to claim 7, wherein the legs have knees facing away from each other and ends facing toward each other.

10. The submersible downhole pump according to claim 7, wherein the loop body is essentially U-shaped.

11. The submersible downhole pump according to claim 7, wherein the loop body is essentially 0-shaped forming essentially a circular arc over at least 270°.

12. The submersible downhole pump according to claim 1, wherein the at least one cable lug comprises a resiliently deformable material.

13. The submersible downhole pump according to claim 1, wherein the at least one cable lug is formed as a spring.

14. The submersible downhole pump according to claim 1, wherein the pivot axis is tangential to the pump unit diameter.

15. The submersible downhole pump according to claim 1, wherein the upper pump end comprises an upper end portion defining an inner volume for accommodating the anchor portion, the at least one cable lug comprising a cable lug portion extending from a position in the inner volume to a position located outside of the pump unit.

16. The submersible downhole pump according to claim 1, wherein the upper pump end comprises an upper pump end portion defining at least a portion of the pivot axis, the upper pump end portion being arranged within the pump unit diameter.

17. A submersible downhole pump comprising:

an elongate pump unit defining a longitudinal pump axis and a pump unit diameter; and at least one cable lug for attaching a cable, the at least one cable lug being connected to the pump unit and the at least one cable lug being pivotable, around a pivot axis perpendicular to the longitudinal axis, between a defined first position and a defined second position, wherein in the first position, the at least one cable lug is positioned fully within the pump unit diameter and, in the second position, the at least one cable lug is positioned at least partially protruding outside the pump unit diameter, wherein, the pump unit defines an inner volume for accommodating an anchor portion of the at least one cable lug and at least one opening for a loop body of the at least one cable lug to protrude out of the inner volume.

18. The submersible downhole pump according to claim 17, wherein dimensions of the inner volume or dimensions of the at least one opening or both the dimensions of the inner volume and the dimensions of the at least one opening are configured to resiliently deform the anchor portion of the at least one cable lug when the at least one cable lug is pivoted from the first position into the second position.

19. The submersible downhole pump according to claim 17, wherein the pivot axis is tangential to the pump unit diameter.

20. The submersible downhole pump according to claim 17, wherein the at least one cable lug comprises a cable lug portion extending from a position in the inner volume to a position located outside of an outer surface of the pump unit.

* * * * *